United States Patent [19]

Bulloch et al.

[11] Patent Number: 5,016,870

[45] Date of Patent: May 21, 1991

[54] EXERCISE DEVICE

[76] Inventors: Russell G. Bulloch, 578 E. 1090 North, Orem, Utah 84057; Craig K. Garrick, 1720 N. 1450 East, Provo, Utah 84604

[21] Appl. No.: 477,610

[22] Filed: Feb. 9, 1990

[51] Int. Cl.[5] ..... A63B 21/00

[52] U.S. Cl. ..... 272/73; 272/132

[58] Field of Search ..... 272/72, 73, 130, 131, 272/132, 134; 128/28 R

[56] References Cited

U.S. PATENT DOCUMENTS

| | | | |
|---|---|---|---|
| D. 191,792 | 11/1961 | Maratta . | |
| D. 283,636 | 4/1986 | Lepley . | |
| 2,565,348 | 8/1951 | Brockman et al. . | |
| 3,213,852 | 11/1965 | Zent . | |
| 3,216,722 | 11/1965 | Odom . | |
| 3,501,142 | 3/1970 | Johansson | 272/73 |
| 3,572,699 | 3/1971 | Nies . | |
| 3,601,395 | 8/1971 | Morgan . | |
| 3,727,608 | 4/1973 | Simsian . | |
| 3,759,512 | 9/1973 | Yount et al. . | |
| 3,831,942 | 8/1974 | Del Mar | 272/73 |
| 3,833,216 | 9/1974 | Philbin | 272/73 |
| 3,964,742 | 6/1976 | Carnielli . | |
| 3,966,201 | 6/1976 | Mester . | |
| 3,995,491 | 12/1976 | Wolfla, II | 272/73 X |
| 4,071,235 | 1/1978 | Zent . | |
| 4,222,376 | 9/1980 | Praprotnik . | |
| 4,402,502 | 9/1983 | Peters . | |
| 4,423,863 | 1/1984 | Figueroa . | |
| 4,436,097 | 3/1984 | Cunningham . | |
| 4,463,945 | 8/1984 | Spector . | |
| 4,509,742 | 4/1985 | Cones . | |
| 4,521,012 | 6/1985 | Cosby et al. . | |
| 4,572,501 | 2/1986 | Durham et al. . | |
| 4,602,781 | 7/1986 | La Marsh et al. . | |
| 4,625,962 | 12/1986 | Street | 272/132 |
| 4,630,818 | 12/1986 | Saarinen | 272/73 |
| 4,684,126 | 8/1987 | Dalebout et al. . | |
| 4,693,468 | 9/1987 | Kurlytis et al. . | |
| 4,729,559 | 3/1988 | McNeil . | |
| 4,762,317 | 8/1988 | Camfield et al. . | |
| 4,824,102 | 4/1989 | Lo . | |
| 4,842,269 | 6/1989 | Huang | 272/132 X |

FOREIGN PATENT DOCUMENTS

| | | | |
|---|---|---|---|
| 1046579 | 10/1966 | United Kingdom | 272/73 |

*Primary Examiner*—Robert Bahr

*Attorney, Agent, or Firm*—Kelly, Bauersfeld & Lowry

[57] ABSTRACT

An exercise device in the nature of an exercise bicycle includes a ground supported frame, a seat supported by the frame, a first flywheel supported for rotation by the frame, and pedals operatively connected to the first flywheel such that rotation of the pedals causes rotation of the first flywheel. A user positioned on the seat and turning the pedals with his feet may obtain aerobic exercise for the lower portion of the body. Additionally, a second flywheel is supported for rotation by the frame, and handlebars are operatively connected to the second flywheel such that alternately pushing and pulling on the handlebars causes rotation of the second flywheel. The handlebars may be moved by the user to turn the second flywheel to obtain aerobic exercise for the upper portion of the body independently of, or simultaneously with, the aerobic exercise of the lower portion of the body. Each of the flywheels is provided with an adjustable friction band by which resistance to the respective flywheel may be controlled by the user. Further, each flywheel is provided with a free-wheel clutch which permits the handlebars and the pedals to be brought to an immediate stop as desired by the user, without the user being required to overcome the inertial force of the respective flywheel.

1 Claim, 2 Drawing Sheets

FIG. 3
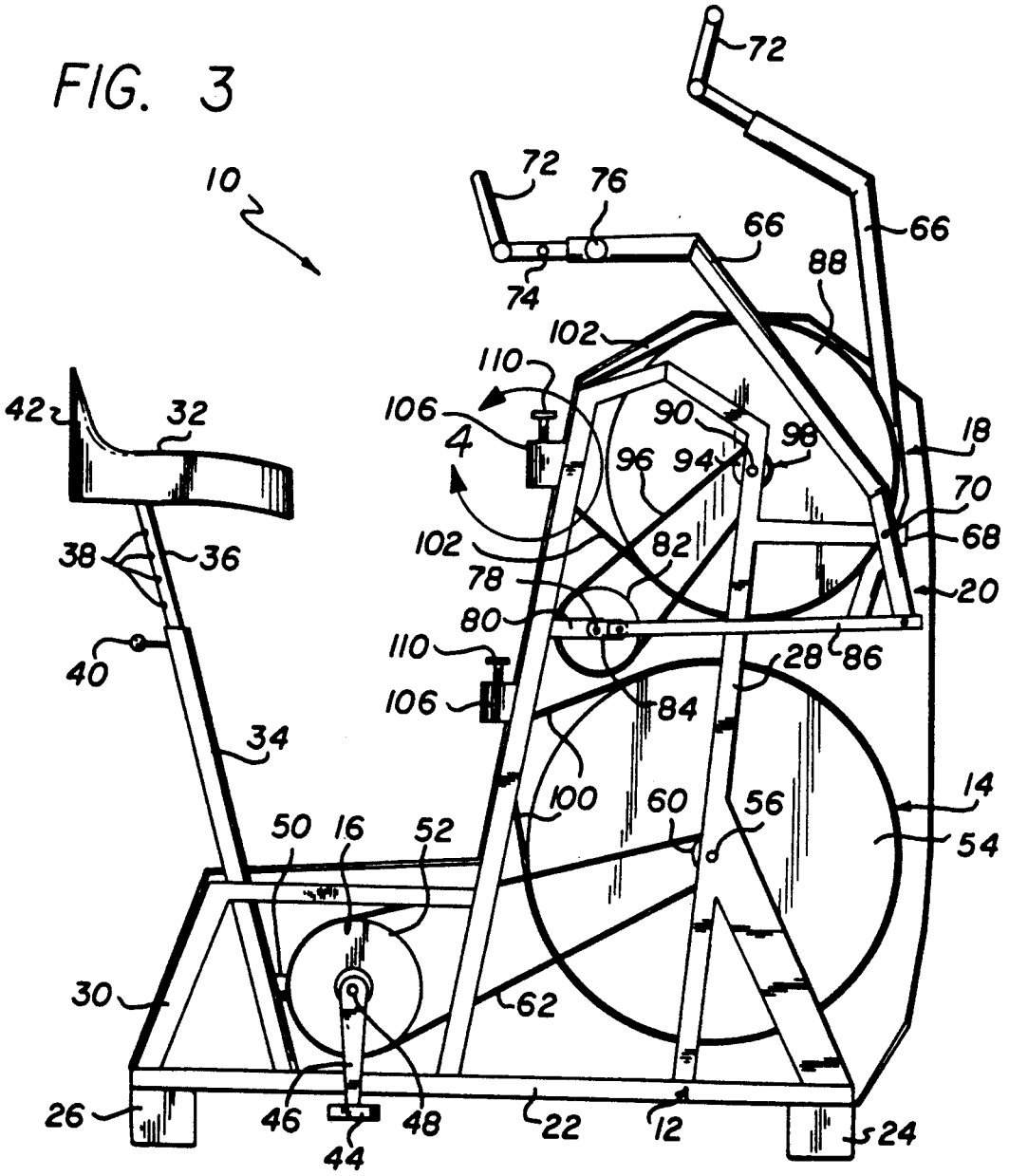
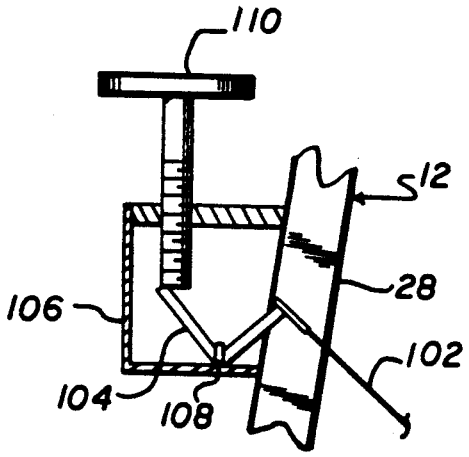
FIG. 4

EXERCISE DEVICE

BACKGROUND OF THE INVENTION

This invention relates generally to exercise equipment. More particularly, the resent invention relates to cardiovascular exercise apparatus of the bicycle-type, specifically adapted to provide independently adjustable conditioning of both the upper and lower extremities of a user.

It is generally recognized in the medical profession that routine exercise programs are beneficial, if not necessary, to improved cardiovascular, pulmonary, and neuro-muscular health. In this regard, many physicians now prescribe moderately intense aerobic exercise programs for heart rehabilitation and preventive care. The recognition of these benefits associated with routine exercise has caused many to adopt a regular exercise regimen, which has led to an explosion in various exercise programs such as jogging, weight lifting, aerobic dancing, and cycling. Although all of these exercise programs have proven beneficial in their general application, each possesses certain deficiencies which have detracted from its overall effectiveness.

Exercise equipment can be classified primarily as equipment intended for aerobic exercise and equipment intended for anaerobic exercise. Aerobic exercise stimulates the action of the heart and lungs and the circulation of the blood. Anaerobic exercise, on the other hand, involves the conditioning or toning of muscles and muscle groups. Naturally, because of the repetitive nature of exercise, there is some overlap in the effects of each of these categories of exercise. For example, an exercise bicycle, which is an aerobic exerciser, also causes the leg muscles to be toned to some extend because of the continuous peddling action. Anaerobic exercise equipment, for example free weights, will cause increased heart and lung action if the weights are sufficiently heavy or the exercise regime of sufficient duration. Neither of these categories of exercise is superior to the other and, in fact, a good exercise program normally involves both types.

An exercise bicycle is a well known piece of aerobic exercise equipment which many individuals have in their homes. Stationary bicycle exercisers are known in which the user, sitting on a raised bicycle seat, operates pedals with his feet to turn a front wheel whose rotation is subject to an adjustable resistance to vary the required effort. Such machines are suitable for developing the leg muscles, but afford little exercise to other parts of the body. Attempts have been made to combine an exercise bicycle with upper body conditioning devices, but these attempts have primarily involved cooperative interconnection of the pedals with movable handlebars. Such devices are not totally satisfactory for a combined exerciser because the movement of the handlebars is functionally related to the pedaling operation so that both occur at essentially a uniform rate. Therefore, one desirous of performing more strenuous exercise for his upper body is not able to do so because the pedals rotate at that same rate. It is important that a combined exerciser permit independent exercise of the upper body while allowing the aerobic exercise achieved through the pedaling operation to continue at its own separate rate.

Accordingly, there has been a need for an improved exercise device which provides aerobic exercise for both the upper and lower portions of the body. Such an improved exercise device should permit the upper and lower portions of the body to be exercised independently of the other, and provide separately adjustable resistive forces against which the legs and arms work. Additionally, an improved exercise device is needed which is relatively inexpensive, yet is of sturdy construction to permit extended home use. Further, an improved exercise device is needed which provides proper support to a user seated thereon for extended exercise periods. The present invention fulfills these needs and provides other related advantages.

SUMMARY OF THE INVENTION

The present invention resides in an improved exercise device which provides aerobic exercise for both the upper and lower portions of the body in an exercise bicycle-type apparatus. The exercise device comprises, generally, a ground supported frame and a first flywheel means which is supported for rotation by the frame. Pedal means are operatively connected to the first flywheel means such that rotation of the pedal means causes rotation of the first flywheel means. A second flywheel means is also supported for rotation by the frame and is operatively connected to handlebar means such that alternately pushing and pulling on the handlebar means causes rotation of the second flywheel means. Lower body exercise can be achieved by foot activating the pedal means, while upper body exercise can be achieved, either simultaneously or independently, by pushing and pulling the handlebar means.

In a preferred form of the invention, a seat is provided which includes a lower-back support, and the frame includes a rearwardly disposed, upwardly extending tubular member which telescopingly receives a seat supporting member therein for positioning the seat relative to the frame. Means are provided for adjustably locking the seat supporting member within the upwardly extending tubular member in a manner permitting selective height adjustment of the seat. This locking means includes a spring-loaded pin supported by the upwardly extending tubular member and extending therethrough for engagement with one of a plurality of apertures provided in the seat supporting member.

The pedal means includes a first crank, a first crank shaft, a bearing housing supported by the frame and surrounding the crank shaft, and a first drive sprocket carried by the first crank shaft. The first flywheel means includes a first flywheel and a first driven sprocket which is coplanar with the first drive sprocket. The first driven sprocket and the first drive sprocket are connected by an endless belt such that rotation of the first drive sprocket causes rotation of the first driven sprocket, which in turn causes rotation of the first flywheel. The first flywheel means further includes a first free-wheel clutch connecting the first flywheel to the first driven sprocket, whereby the first free-wheel clutch permits motion to be transmitted from the first driven sprocket to the first flywheel in one direction only.

The handlebar means includes a handlebar pivotally supported by the frame, a second crank shaft, a second bearing housing supported by the frame and surrounding the second crank shaft, a second drive sprocket carried by the second crank shaft, and means for connecting the handlebar to the second crank shaft such that alternately pushing and pulling on the handlebar causes rotation of the second crankshaft. The means for connecting the handlebar to the second crank shaft includes a link connected at a first end to the second crank shaft, and a connecting bar which extends between the link and the handlebar.

The second flywheel means includes a second flywheel and a second driven sprocket which is coplanar with the second drive sprocket and connected thereto by an endless belt such that rotation of the second drive sprocket causes rotation of the second driven sprocket, which in turn causes rotation of the second flywheel. The second flywheel means further includes a second free-wheel clutch connecting the second flywheel to the second driven sprocket. The second free-wheel clutch, like the first free-wheel clutch, permits motion to be transmitted from the second driven sprocket to the second flywheel in one direction only.

Friction band means are anchored to the frame and engage at least a portion of each flywheel means to provide controlled resistance to rotation of each flywheel means. The friction band means includes a first band brake and a second band brake which each extend around at least a portion of the periphery of a respective one of the first and second flywheels. Each flywheel further includes a continuous track provided on its peripheral surface in which the respective band brake is positioned. Means are provided for adjusting the tension of the band brakes about the flywheels, whereby one end of each band brake is anchored to the frame and another end is adjustably positioned with respect to the frame to provide selectively adjustable resistance to movement of the flywheel.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 3 is an enlarged elevational view of the exercise device of FIG. 2; and FIG. 4 is an enlarged fragmented sectional view of the encircled portion of FIG. 3.

DETAILED DESCRIPTION OF THE PREFERRED EMBODIMENT

Figure 1:
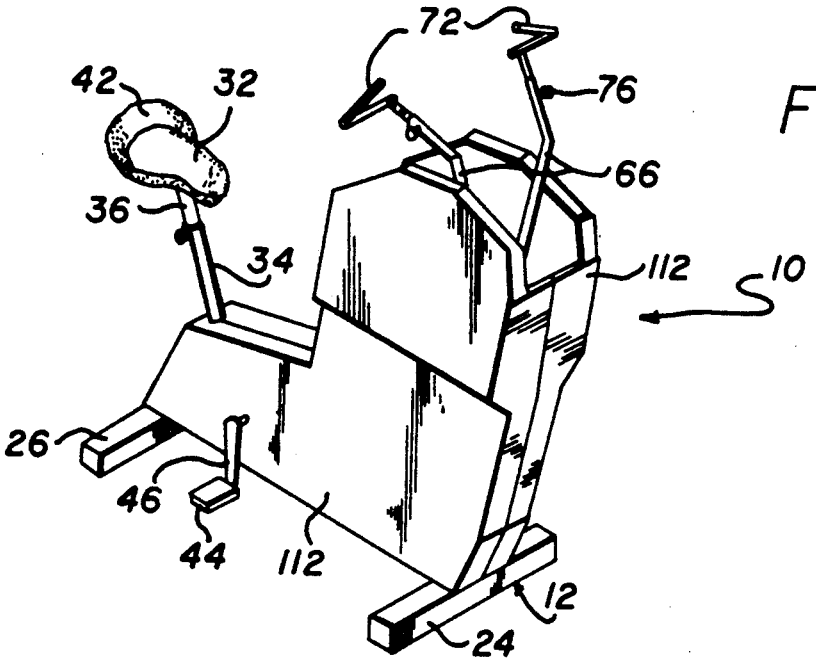
FIG. 1 is a perspective view of a preferred form of an exercise device embodying the invention.

As shown in the drawings for purposes of illustration, the present invention is concerned with an improved exercise device, generally designated in the accompanying drawings by the reference number 10. The exercise device 10 is specifically adapted to provide independently adjustable conditioning of both the upper and lower extremities of a user. More particularly, the exercise device 10 provides aerobic exercise for both the upper and lower portions of the body, whereby lower body exercise can be achieved by foot activating bicycle pedals, while upper body exercise can be achieved, either simultaneously or independently, by pushing or pulling on handlebars.

Figure 2:
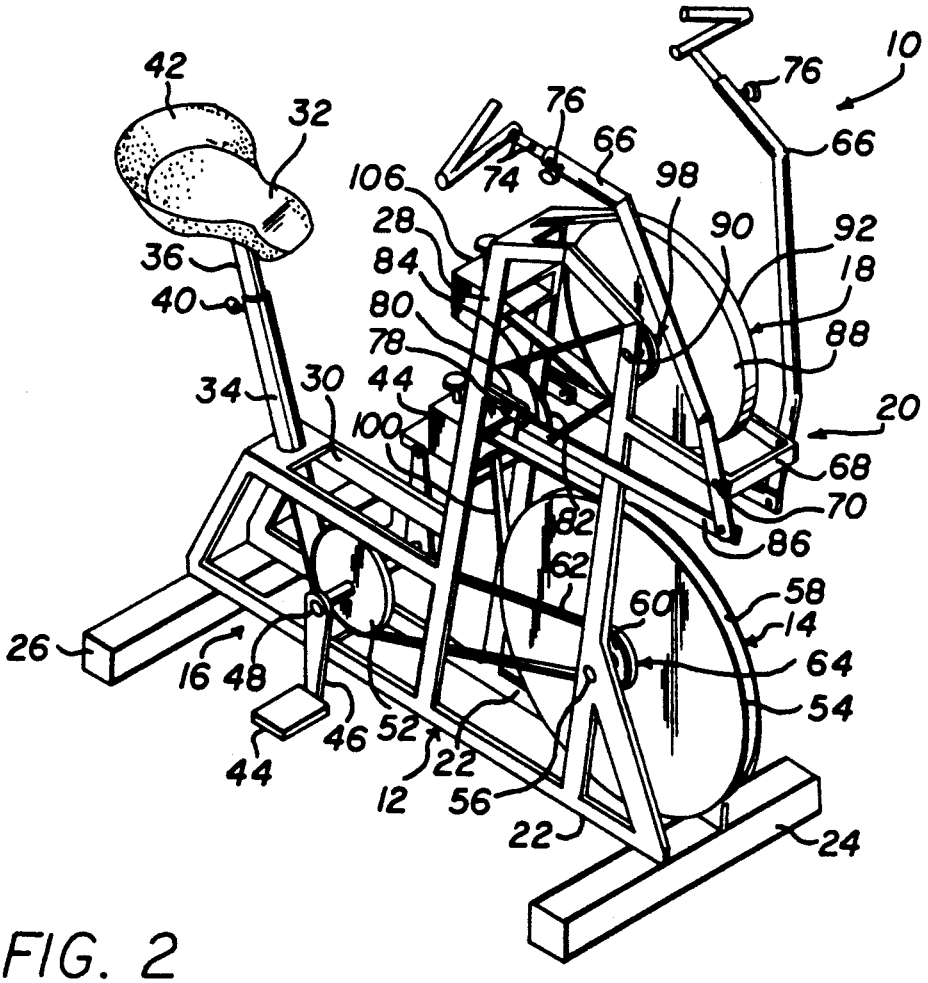
FIG. 2 is an enlarged perspective view of the exercise device illustrated in to FIG. 1, shown with an outer shell encasement removed for purposes of illustrating the internal components thereof.

In accordance with the present invention and as illustrated best in FIGS. 1 through 3, the exercise device 10 comprises, generally, a ground supported frame 12, a first flywheel apparatus 14 supported for rotation by the frame, and a pedal apparatus 16 which is operatively connected to the first flywheel apparatus 14 such that rotation of the pedal apparatus causes rotation of the first flywheel apparatus. Additionally, the exercise device 10 includes a second flywheel apparatus 18 which, like the first flywheel apparatus 14, is supported for rotation by the frame 12, and a handlebar apparatus 20 which is operatively connected to the second flywheel apparatus 18 such that alternately pushing and pulling on the handlebar apparatus causes rotation of the second flywheel apparatus.

The frame 12 includes a pair of lower base members 22 which extend between a transverse front ground support 24 and a transverse rear ground support 26. A forward upper support structure 28 extends upwardly from the base members 22 for supporting the first flywheel apparatus 14, the second flywheel apparatus 18 and the handlebar apparatus 20. A rearward upper support structure 30 also extends upwardly from the base members 22 to provide support for the pedal apparatus 16 and a seat 32 for the user. The front and rear ground supports 24 and 26 are provided with anti-skid pads on the lower surfaces thereof to inhibit unwanted movement of the exercise device while in use.

The rearward upper support structure 30 includes a rearwardly disposed, upwardly extending tubular member 34 which telescopingly receives a seat supporting member 36 attached to the underside of the seat 32, for positioning the seat relative to the frame 12. The seat supporting member 36 includes a plurality of apertures 38 spaced along the length thereof which may be aligned with a spring-loaded locking pin 40 supported at the upper end of the tubular member 34, for locking the seat supporting member 36 in a desired position within the tubular member. Thus, the height of the seat 32 can be selectively adjusted to fit the requirements of different users of the exercise device 10 by telescoping the seat supporting member 36 into or out of the tubular member 34 and then locking those two members in place by means of the locking pin 40. The seat 32 further includes a lower-back support 42 which increases the comfort of the seat and permits extended use of the exercise device 10.

The pedal apparatus 16 forms a relatively standard bicycle pedal arrangement and includes a pair of footrests 44 rotatably fixed to respective pedal cranks 46 which, in turn, are fixed to a pedal crank shaft 48. The pedal cranks 46 are fixed to the crank shaft 48 such that the footrests 44 are disposed 180° from one another to facilitate the pedaling action of the user. A pedal crankshaft bearing housing is supported within a brace 50, and the bearing housing surrounds a portion of the crank shaft 48. A pedal drive sprocket 52 is carried by the crank shaft 48, and may be in the form of a bicycle sprocket or, preferably, is provided in the form of a pulley.

The first flywheel apparatus 14 includes a flywheel 54 mounted for rotation relative to the frame 12 on a shaft 56 which is supported by the forward upper support structure 28. The flywheel 54 includes a continuous track 58 provided on its peripheral surface, the purpose of which will be discussed in greater detail below. The first flywheel apparatus 14 further includes a driven sprocket 60 mounted upon the shaft 56 and situated in the same plane as the pedal drive sprocket 52. The driven sprocket 60 and pedal drive sprocket 52 are connected to one another by an endless belt 62 whereby rotation of the pedal drive sprocket 52 causes rotation of the driven sprocket 60, which in turn causes rotation of the flywheel 54. The driven sprocket 60, like the pedal drive sprocket 52, can be similar to sprockets found on bicycles, in which case the endless belt 62 would preferably be a silent chain, or the driven sprocket 60 can be a pulley in which case the endless belt would be of the V-belt type.

A free-wheel clutch 64 connects the flywheel 54 and the driven sprocket 60 in a manner permitting motion to be transmitted from the driven sprocket 60 to the flywheel 54 in one direction only. This advantageously permits a user to immediately stop turning the pedal apparatus 16 without having to overcome the inertial forces of the first flywheel apparatus 14.

The handlebar apparatus 20 includes a pair of handlebars 66 which are each pivotally attached to a handlebar brace 68 extending forwardly from the forward upper support structure 28 of the frame 12. This attachment of the handlebars 66 to the brace 68 may be by means of a pin 70 or any other suitable pivot bushing. The upper end of each handlebar 66 extends rearwardly toward a user positioned on the seat 32, and telescopingly receives an adjustable handle grip 72 therein. Each handle grip 72 includes a series of apertures 74 located on the portion which slides within the handlebar 66, and these apertures may be aligned with a spring-loaded locking pin 76 for locking the handle grip 72 with respect to the handlebar 66. The locking pin 76 is similar to the locking pin 40 discussed above in connection with the seat 32. It is supported on the handlebar 66 and extends therethrough for engagement with a selected aperture 74 of the handle grip 72. This permits the precise positioning of the handle grips 72 to be adjusted for accommodating various users of the exercise device 10.

The handlebar apparatus 20 also includes a second crank shaft 78 which is positioned within a bearing housing supported by the frame 12. In particular, a second crank shaft supporting brace 80 extends from a member of the forward upper support structure 28, for holding the second bearing housing. A second drive sprocket 82 is carried by the second crank shaft 78 and may be constructed like a typical bicycle sprocket or in the form of a pulley. Means are provided for connecting the handlebars 66 to the second crank shaft 78 such that alternately pushing and pulling on the handlebars causes rotation of the second crank shaft. More particularly, a link 84 is attached to each end of the crank shaft 78. Attached to each link 84 is a connecting bar 86 which extends between the link 84 and a lower end of each handlebar 66. The links 84 and the connecting bars 86 form a linkage between the lower end of the handlebars 66 and the second crank shaft 78 such that a rocking or push-pull motion imparted to the handlebars imparts a rotational motion to the second drive sprocket 82.

The second flywheel apparatus 18 includes a second flywheel 88 mounted for rotation relative to the frame 12 on a shaft 90 which is supported by the forward upper support structure 28. The second flywheel 88 includes a continuous track 92 provided on its peripheral surface. The second flywheel apparatus 18 further includes a driven sprocket 94 mounted upon the shaft 90 and situated in the same plane as the second drive sprocket 82. The driven sprocket 94 and second drive sprocket 82 are connected to one another by an endless belt 96 whereby rotation of the second drive sprocket 82 causes rotation of the driven sprocket 94, which in turn causes rotation of the second flywheel 88. The driven sprocket 94, like the second drive sprocket 82, can be similar to sprockets found on bicycles, in which case the endless belt 96 would preferably be a silent chain, or the driven sprocket 94 can be a pulley in which case the endless belt would be of the V-belt type.

A free-wheel clutch 98 connects the second flywheel 88 and the driven sprocket 94 in a manner permitting motion to be transmitted from the driven sprocket 94 to the second flywheel 88 in one direction only. This advantageously permits a user to immediately stop the handlebar apparatus 20 without having to overcome the inertial forces of the second flywheel apparatus 18.

Band brakes are provided each flywheel apparatus to provide controlled resistance to the rotation of the respective flywheel apparatus. More specifically, a first band brake 100 extends around at least a portion of the periphery of the first flywheel 54 and is positioned within the track 58 provided thereby. Similarly, a second band brake 102 extends around at least a portion of the periphery of the second flywheel 88, and it too is positioned within the continuous track 92 provided by the second flywheel. One end of each band brake 100 and 102 is anchored to a portion of the forward upper support structure 28, and the other end is adjustably positioned with respect to the frame 12 to provided selectively adjustable resistance to the respective free-wheel apparatus. As shown best in FIG. 4, this second end of each band brake is attached to a V-shaped tension lever 104. The tension lever 104 is fixed within an enclosure 106 attached to one of the frame members, by means of a pivot anchor 108. Positioning of the tension lever 104 within the enclosure 106 is controlled by means of a threaded pin 110 which extends through the enclosure 106 and engages an end of the tension lever opposite the band brake. Threading the pin 110 into the enclosure 106 tends to tighten the band brake 100, 102 about its respective flywheel 54, 88, which results in increased resistance to movement of that flywheel.

The foregoing described structural features of the invention are encased within a lightweight shell 112 which is provided to safely shield the user from the internal moving components of the exercise device 10.

To utilize the exercise device 10, a user would first adjust the height of the seat 32 by placing the spring-loaded locking pin 40 in the appropriate aperture 38 in the seat supporting member 36. The seat 32 is preferably positioned to maximize extension of the legs as they turn the pedal apparatus 16. The lower back support 42 has been designed to provide critical lower-back support to increase comfort of the user during extended exercise periods.

Next, the handle grips 72 are adjusted into or out of each handlebar 66 utilizing the spring-loaded locking pins 76 and the apertures 74. Again, it is deemed preferable that the handle grips be adjusted to permit maximum extension of the arms during the exercise process. The user then simply begins to pedal the pedal apparatus 16, which turns the first flywheel apparatus 14. Resistance on the first flywheel 54 may be adjusted by tightening the first band brake 100. As discussed above, this is accomplished by simply turning the pin 110 within the associated enclosure 106. Pedaling against the resistive force of the first flywheel 54 can give the user an intensive aerobic workout of the lower body.

A similar intensive aerobic workout of the upper body can be achieved through push-pull action exerted on the handle grips 72 by the user. By alternately pushing and pulling on the handle grips 72, and pivoting the handlebars 66 on the pin 70, the user is able to turn the second drive sprocket 82 which, in turn, drives the second flywheel 88.

The resistance to rotation of the second flywheel 88 may be controlled by adjusting the tension on the second band brake 102.

From the foregoing it is to be appreciated that the improved exercise device 10 is capable of operating reliably and efficiently, and provide aerobic exercise for both the upper and lower portions of the body. The exercise device 10 is of relatively simple construction and yet is sturdy to permit extended home use. Additionally, the improved exercise device 10 permits the upper and lower portions of the body to be exercised independently of the other, and provides separately adjustable resistive forces against which the legs and arms work. By providing free-wheel clutches, both the handlebar apparatus 20 and the pedal apparatus 16 can be safely brought to an immediate stop by the user if necessary, without having to overcome the inertial forces generated by the flywheels.

Although a particular embodiment of the invention has been described in detail for purposed of illustration, various modifications may be made without departing from the spirit and scope of the invention. Accordingly, the invention is not to be limited, except as by the appended claims.

We claim:

1. A dual action exercise device, comprising:

a ground supported frame having a seat, wherein the seat includes a lower-back support, and wherein the frame includes a rearwardly disposed, upwardly extending tubular member which telescopingly receives a seat supporting member therein for positioning the seat;

means for adjustably locking the seat supporting member within the upwardly extending tubular member in a manner permitting selective height adjustment of the seat, the locking means including a spring-loaded pin supported by the upwardly extending tubular member and extending therethrough for engagement with one of a plurality of apertures provided in the seat supporting member;

pedal means supported by the frame and including a first crank, a first crank shaft, a first bearing housing supported by the frame and surrounding the first crank shaft, and a first drive sprocket carried by the first crank shaft;

first flywheel means supported for rotation by the frame and operatively connected to the pedal means such that rotation of the pedal means causes rotation of the first flywheel means, the first flywheel means including a first flywheel and a first driven sprocket which is coplanar with the first drive sprocket and connected thereto by a silent chain whereby rotation of the first drive sprocket causes rotation of the first driven sprocket, which, in turn, causes rotation of the first flywheel, wherein the first flywheel means further includes a first free-wheel clutch connecting the first flywheel to the first driven sprocket, whereby the first free-wheel clutch permits motion to be transmitted from the first driven sprocket to the first flywheel in one direction only;

first friction band means anchored to the frame and engaging at least a portion of the first flywheel means to provided controlled resistance to rotation of the first flywheel means, wherein the first friction band means includes a first band brake extending around at least a portion of the periphery of the first flywheel, and means for adjusting the tension of the first band brake about the first flywheel, whereby one end of the first band brake is anchored to the frame, and another end of the first band brake is adjustably positioned with respect to the frame by the first band brake adjusting means to provide selectively adjustable resistance to the first flywheel means;

handlebar means including a handlebar pivotally supported by the frame, a second crank shaft, a second bearing housing supported by the frame and surrounding the second crank shaft, a second drive sprocket carried by the second crank shaft, and means for connecting the handlebar to the second crank shaft such that alternately pushing and pulling on the handlebar causes rotation of the second crank shaft, wherein the means for connecting the handlebar to the second crank shaft includes a link connected at a first end to the second crank shaft, and a connecting bar pivotally attached to a second end of the link at one end, and pivotally attached to the handlebar at another end;

second flywheel means supported for rotation by the frame and operatively connected to the handlebar means such that alternately pushing and pulling on the handlebar means causes rotation of the second flywheel means, wherein the second flywheel means includes a second flywheel and a second driven sprocket which is coplanar with the second drive sprocket and connected thereto by a silent chain whereby rotation of the second drive sprocket causes rotation of the second driven sprocket, which in turn causes rotation of the second flywheel, wherein the second flywheel means includes a second free-wheel clutch connecting the second flywheel to the second driven sprocket, whereby the second free-wheel clutch permits motion to be transmitted from the second driven sprocket to the second flywheel in one direction only; and a second friction band means anchored to the frame and engaging at least a portion of the second flywheel means to provided controlled resistance to rotation of the second flywheel means, wherein the second friction band means includes a second band brake extending around at least a portion of the periphery of the second flywheel, and means for adjusting the tension of the second band brake about the second flywheel, whereby one end of the second band brake is anchored to the frame, and another end of the second band brake is adjustably positioned with respect to the frame by the second band brake adjusting means to provide selectively adjustable resistance to the second flywheel means;

whereby lower body exercise can be achieved by foot activating the pedal means while upper body exercise can be achieved, either simultaneously or independently, by pushing and pulling the handlebar means.

* * * * *